US010215522B1

(12) United States Patent
Kempf et al.

(10) Patent No.: US 10,215,522 B1
(45) Date of Patent: Feb. 26, 2019

(54) ADJUSTABLE TRIGGER PULL FOR A CROSSBOW

(71) Applicants: James J. Kempf, Coralville, IA (US); Rex E. Isenhower, Stanwood, IA (US)

(72) Inventors: James J. Kempf, Coralville, IA (US); Rex E. Isenhower, Stanwood, IA (US)

(73) Assignee: ARCHERY INNOVATORS, LLC, Tiffin, IA (US)

( * ) Notice: Subject to any disclaimer, the term of this patent is extended or adjusted under 35 U.S.C. 154(b) by 0 days.

(21) Appl. No.: 15/818,794

(22) Filed: Nov. 21, 2017

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01); *F41B 5/123* (2013.01)

(58) Field of Classification Search
CPC ..... F41B 5/12; F41B 5/123
See application file for complete search history.

(56) References Cited

U.S. PATENT DOCUMENTS

| | | | |
|---|---|---|---|
| 5,884,614 | A | 3/1999 | Darlington et al. |
| 6,205,990 | B1 | 3/2001 | Adkins |
| 6,736,123 | B1 | 5/2004 | Summers et al. |
| 7,814,894 | B2 | 10/2010 | Giroux |
| 8,770,178 | B2 | 7/2014 | Kempf |
| 8,899,218 | B2 | 12/2014 | Kempf |
| 9,255,754 | B1 | 2/2016 | Kempf |

*Primary Examiner* — John Ricci
(74) *Attorney, Agent, or Firm* — Donald J. Ersler

(57) ABSTRACT

An adjustable trigger mechanism assembly for a crossbow includes a trigger housing, a sear lever, a latch, trigger lever, and a linkage arm. The sear lever is pivotally engaged with the trigger housing and controls the movement of the latch. One end of the linkage arm is pivotally engaged with the sear lever. The trigger lever is pivotally engaged with the trigger housing. The trigger lever includes at least two moment arm holes for pivotally engaging an opposing end of the linkage arm. In an alternative embodiment, the at least two moment arm holes are formed in the sear lever. The at least two moment arms cause the trigger lever to have at least two different pull distances and pull forces.

12 Claims, 9 Drawing Sheets

ADJUSTABLE TRIGGER PULL FOR A CROSSBOW

BACKGROUND OF THE INVENTION

1. Field of the Invention

The present invention relates generally to archery, and more specifically to an adjustable trigger pull for a crossbow, which allows an archer to choose multiple settings for adjusting travel and poundage of a trigger.

2. Discussion of the Prior Art

U.S. Pat. No. 5,884,614 to Darlington et al. discloses a crossbow with improved trigger mechanism. U.S. Pat. No. 6,205,990 discloses a dry-fire prevention mechanism for crossbows. U.S. Pat. No. 6,736,123 to Summers et al. discloses a crossbow trigger. U.S. Pat. No. 7,814,984 to Giroux discloses a anti dry-fire device for crossbows. U.S. Pat. No. 9,255,754 to Kempf discloses a crossbow lock mechanism. U.S. Pat. Nos. 8,770,178 and 8,899,218 to Kempf disclose an adjustable trigger, however the mounting positions for the linkage arm on the trigger lever are not on a constant radius relative to the linkage arm pivot point on the sear lever. Therefore, the manner by which it operates is not acceptable for smooth operation and function.

Historically, trigger pull on a crossbow has been mediocre at best, ranging from 5 to 12 pounds, and more recently as low as 2.75 pounds. In 2016, Bear Archery introduced an adjustable trigger for a crossbow, the adjustment was made merely by increasing or decreasing spring load pressure biased on the sear. Though this did alter the perceived trigger pull poundage, it did nothing to alter the trigger pull travel.

Accordingly, there is a clearly felt need in the art for an adjustable trigger for a crossbow, which allows an archer to choose multiple settings for the trigger, adjusting travel and poundage of a trigger of a crossbow.

SUMMARY OF THE INVENTION

The present invention provides an adjustable trigger for a crossbow, which allows an archer to choose multiple settings for the trigger, adjusting travel and poundage of a trigger of a crossbow. A crossbow includes a riser, a barrel, two bow limbs, two cams, a bow string, a trigger housing and a stock. The stock is attached to one end of the barrel. The riser is attached to the barrel in front of the stock. The bow limbs extend from opposing ends of the riser. Each bow limb is terminated with one of the two cams. The bow string is retained on the two cams. The trigger housing is contained within the stock or barrel.

The adjustable trigger pull for a crossbow includes the trigger housing, a sear lever, a sear lock lever, a string latch, a safety, trigger-to-sear link, and a trigger lever. A mechanism cavity is formed in the trigger housing to receive and retain the sear lever, the combination anti-dryfire and sear lock lever and the string latch. The sear lever includes a sear base, an anti-dryfiring projection, a latch projection, and an elongated pivot link. The anti-dryfiring projection extends from one end of the sear base and the elongated pivot link extends from an opposing end of the sear base. The latch projection extends outward from a length of the sear base. One end of the elongated pivot link is pivotally retained in the mechanism cavity. An opposing end of the elongated pivot link is pivotally engaged with the trigger.

The trigger includes a trigger lever and a trigger-to-sear link. An end of the trigger lever is pivotally retained on the barrel. A first end of the trigger-to-sear link is pivotally retained on the trigger lever, adjacent the trigger lever pivot point. The trigger lever may include multiple connecting points for the pivotal retention of the first end of the trigger-to-sear link. These multiple connection points are on an arc relative to the axis point of the second end of the trigger-to-sear link connection to the sear lever. The second end of the trigger-to-sear link is pivotally retained on the sear lever. The string latch includes a latch base, an arrow shaft yoke, a sear notch and a spring projection. The arrow shaft yoke extends from one side of the latch base and the spring projection extends from an opposing side of the latch base at one end thereof. The sear notch is formed in an opposing end of the latch base. The string latch is pivotally retained in the mechanism cavity adjacent the spring projection. The sear notch engages the latch projection.

The sear lock lever includes a latch finger and an impact finger. The latch finger extends from one end of the sear lock lever and the impact finger extends from an opposing end of the sear lock lever. The latch finger is sized to capture the anti-dryfiring projection. A sear lever stop extends outward from the mechanism cavity, above the sear base and between the anti-dry firing projection and the latch projection to stop excessive upward motion of the sear lever. A latch ball stop is preferably retained between the impact finger and the sear lever stop, but may have other suitable locations. A safety bar is slideably located to engage with the sear lever, so that when the safety bar is in a safe position, the sear lever is constrained from movement, and when the safety bar is in a fire position, the safety bar does not interfere with the movement of the sear lever.

In use, the trigger-to-sear link may connected with the trigger lever in a first position, a second position, or more positions. Said first position may provide the lightest poundage trigger pull, with the greatest trigger lever travel. Said second position may provide for a decreased poundage trigger pull and shortened trigger lever travel relative to the said first position, and so on.

In an alternate embodiment, the sear lever may include multiple connecting points for a second pivot end of the trigger-to-sear link.

Accordingly, it is an object of the present invention to provide an adjustable trigger pull for a crossbow, which allows a user to select the preferred trigger poundage and trigger lever travel.

These and additional objects, advantages, features and benefits of the present invention will become apparent from the following specification.

DETAILED DESCRIPTION OF THE PREFERRED EMBODIMENTS

Figure 1:
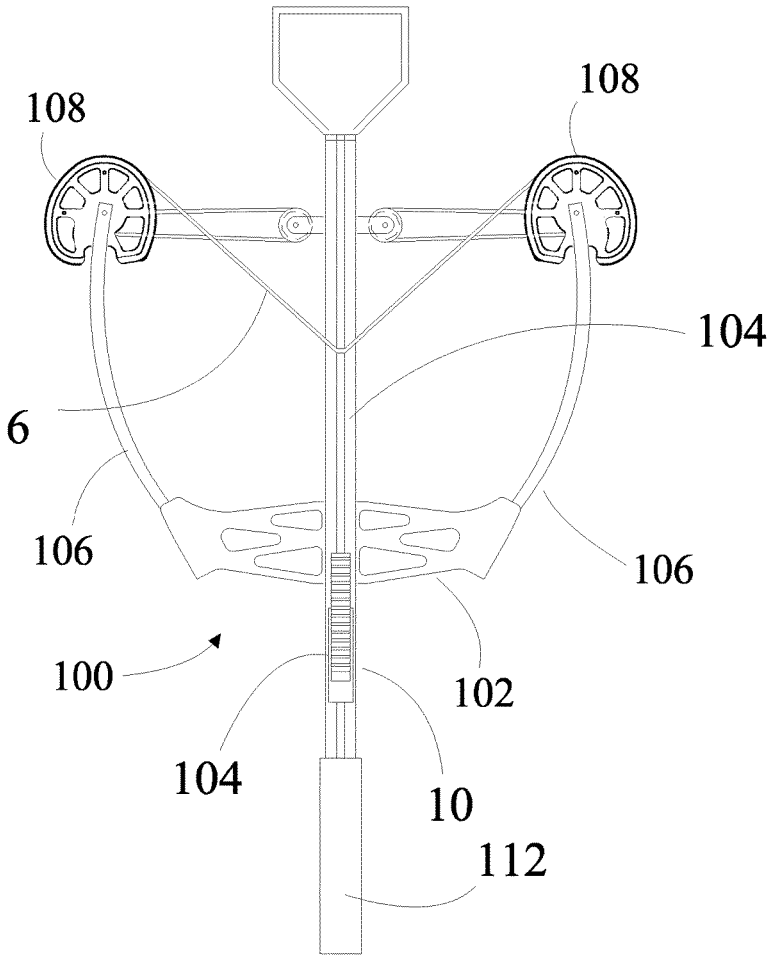
FIG. 1 is a top view of a crossbow including an adjustable trigger pull in accordance with the present invention.
Figure 2:
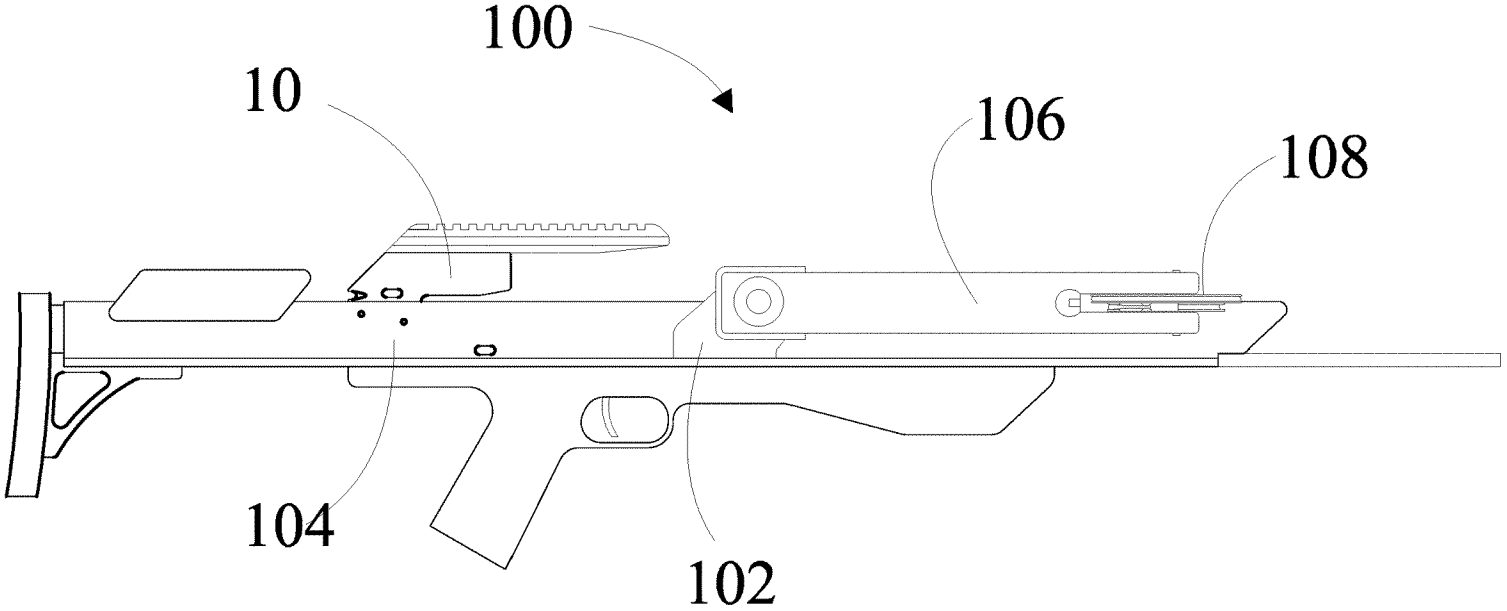
FIG. 2 is a side view of a crossbow an adjustable trigger pull in accordance with the present invention.
Figure 3A:
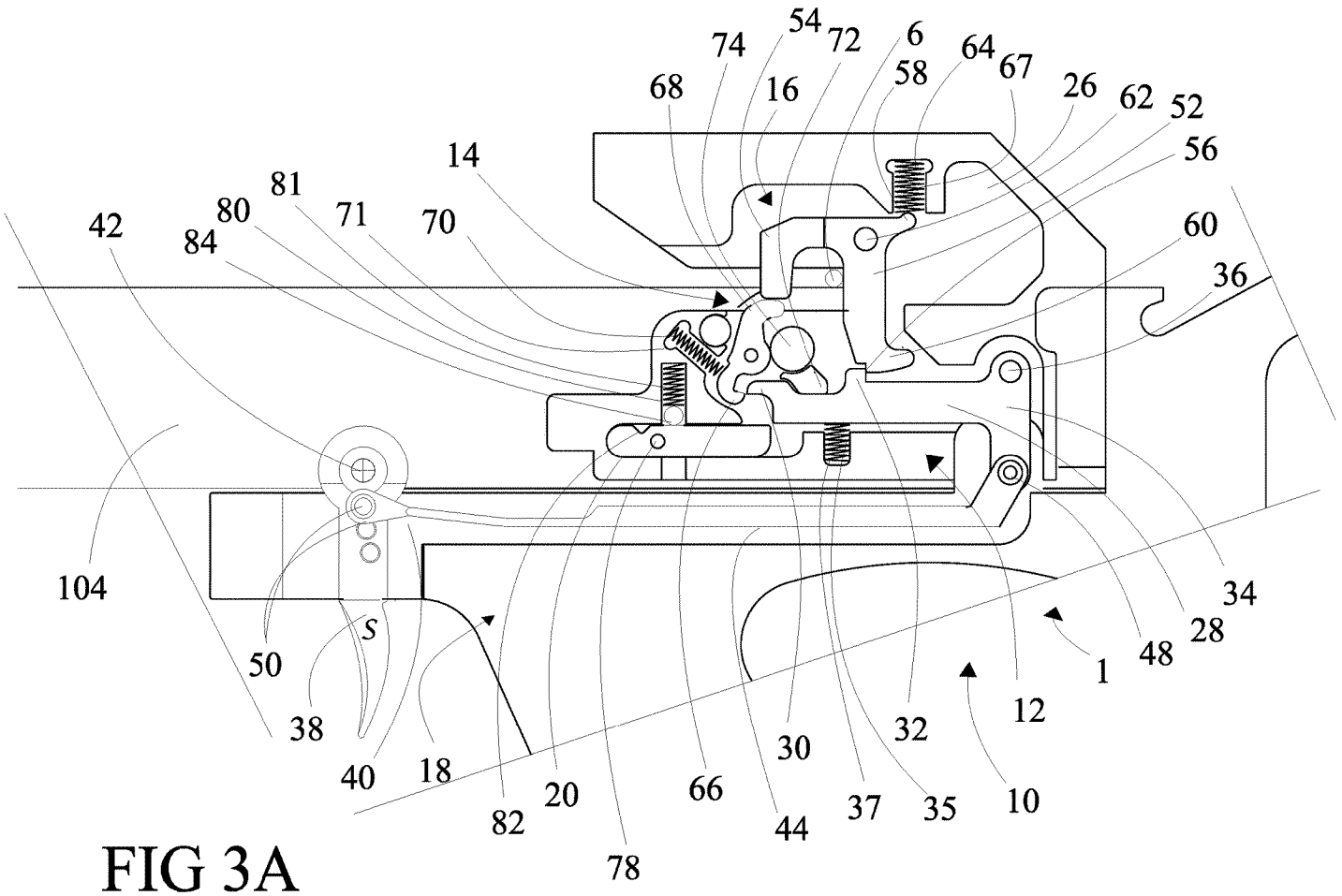
FIG. 3A is a side view of a crossbow with an adjustable trigger pull showing the trigger housing with a cover removed in accordance with the present invention.

With reference now to the drawings, and particularly to FIGS. 1-2, there are shown a crossbow 100 including an adjustable trigger. The crossbow 100 includes a riser 102, a barrel 104, two bow limbs 106, two cams 108, a bow string 6, a stock 112 and a trigger housing 10. The two bow limbs 106 extend from opposing ends of the riser 102. The stock 112 extends from one end of the barrel 104. The riser 102 is attached to the barrel 104 in front of the stock 112. Each bow limb 106 is terminated with one of the two cams 108. The bow string 6 is retained on the two cams 108. The trigger housing 10 is contained within the stock 112. With reference to FIG. 3A, the adjustable trigger lever 38 and trigger-to-sear link 44 are located adjacent to the trigger housing 10.

Figure 3B:
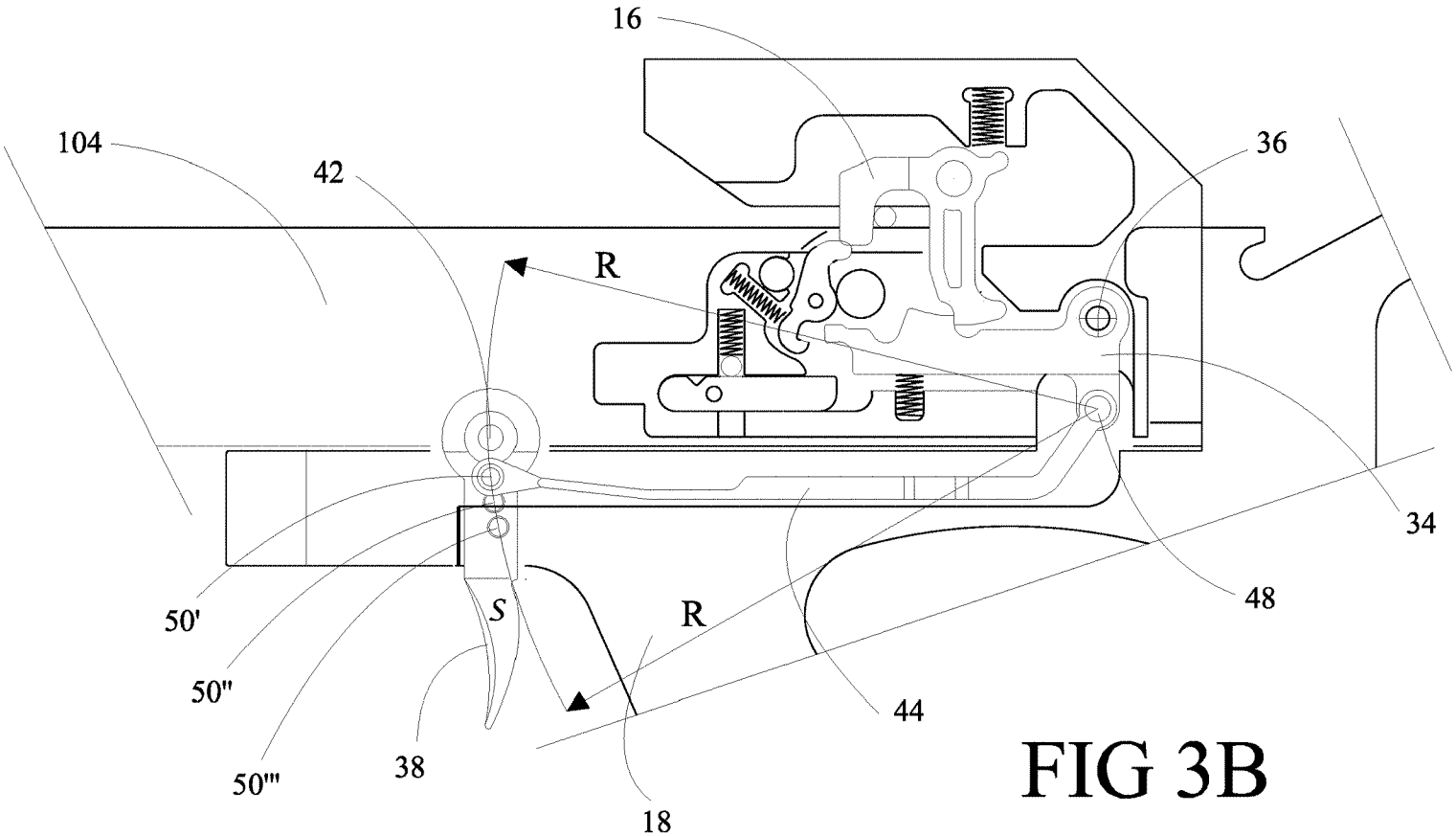
FIG. 3B is a side view a crossbow with an adjustable trigger pull showing the trigger housing with the cover removed to illustrate multiple sear pin positions in accordance with the present invention.

With reference to FIGS. 3A and 3B, the adjustable trigger for a crossbow mechanism preferably includes the trigger housing 10, a sear lever 12, a string latch 16, a trigger lever 38, and a trigger-to-sear link 44. A mechanism cavity is formed in the trigger housing 10 to receive and retain the sear lever 12, the string latch 16 and the safety slide bar 20. The sear lever 12 includes an elongated sear-to-trigger link pivot 44. The sear 12 is pivotally retained in the mechanism cavity 26 with a sear pivot pin 36. The adjustable trigger includes a trigger lever 38 and a trigger-to-sear link 44. An end of the trigger lever 38 is pivotally retained on the barrel 104 with a fastener 42 or the like. The trigger-to-sear link 44 includes an elongated body, a first end, and a second end. The second end of the trigger-to-sear link 44 is pivotally retained with the sear lever 12 by a pivot pin 48. A first end of the trigger-to-sear link 44 is pivotally retained on the trigger lever 38, adjacent the fastener 42 with a pivot pin in a first position 50', a second position 50", or a third position 50'". The distance from the axis of sear pivot pin 48 to the axis of moment arm holes 50', 50", and 50'" are equal, said axis' are on a radius "R" from an axial center of the said sear pivot pin 48.

Figure 3C:
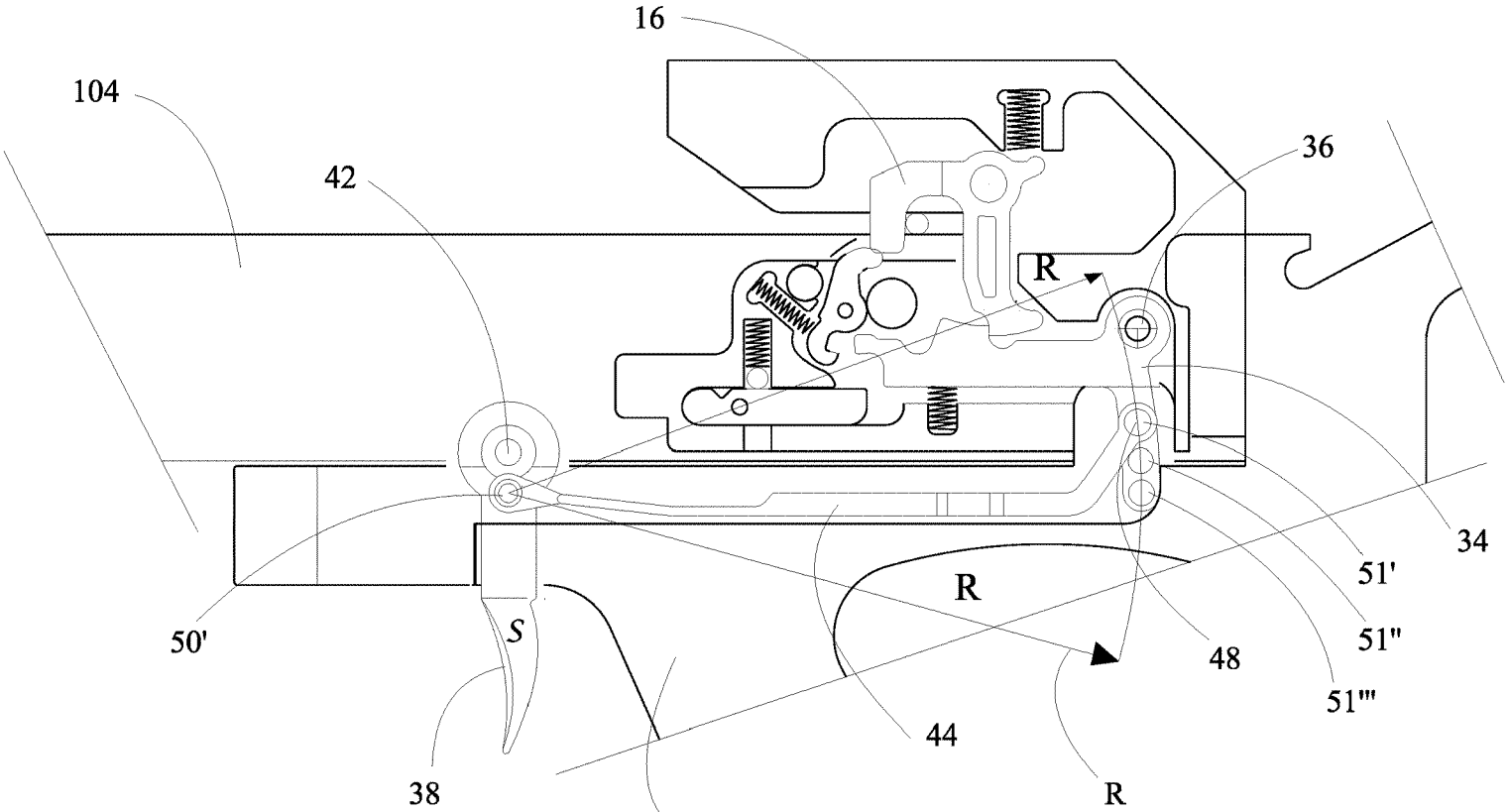
FIG. 3C is a side view a crossbow with an alternate adjustable trigger pull showing a trigger housing with a cover removed in accordance with the present invention.
Figure 4:
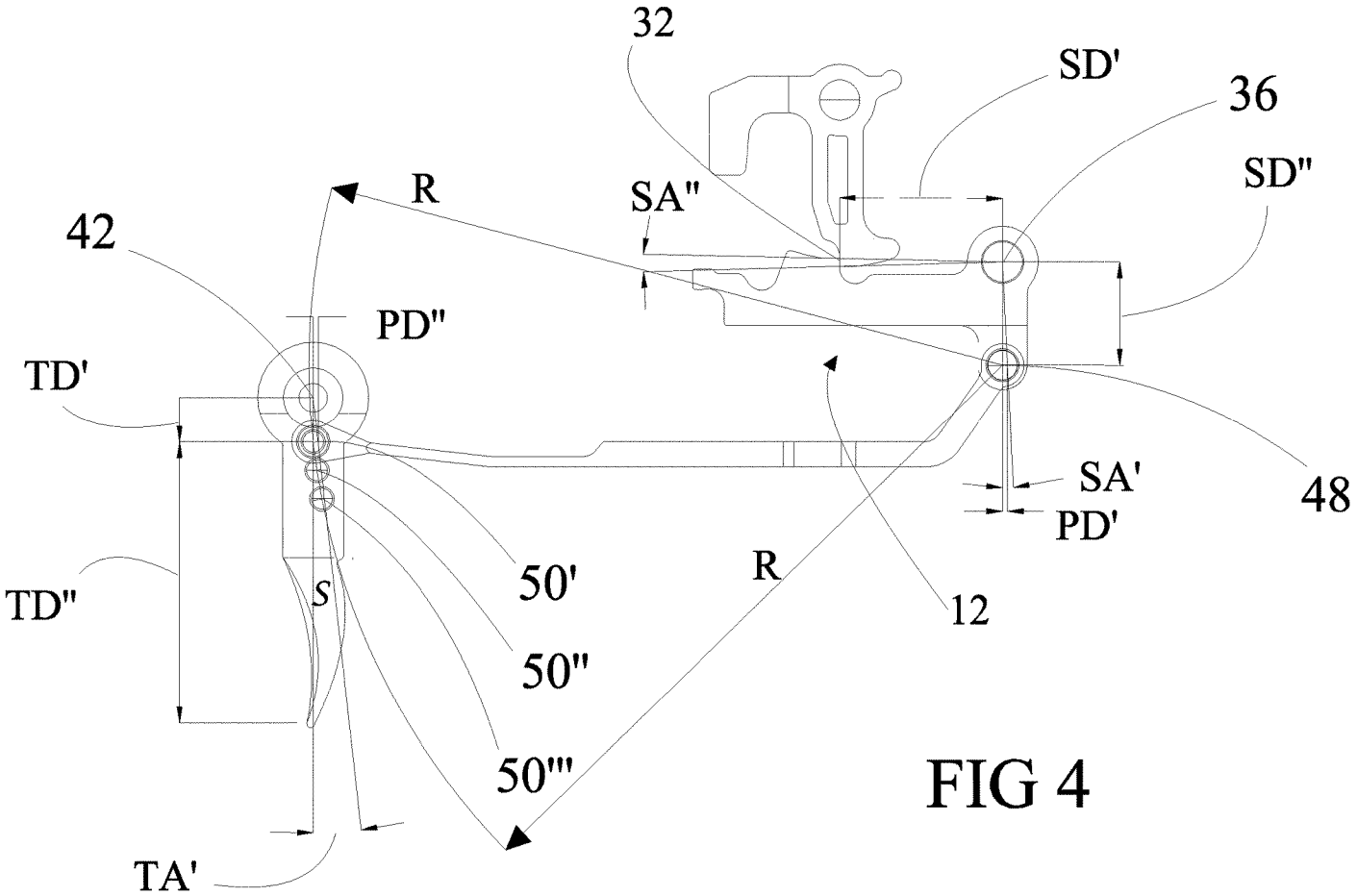
FIG. 4 is a side view of components of an adjustable crossbow trigger pull detailing pivot points and distance parameters, in accordance with the present invention.

With reference to FIG. 3C, shown is an alternate embodiment of the present invention, wherein the multiple adjustment pivot pin locations 51', 51", and 51'" are located on the sear lever 12 as opposed to the trigger lever 38. With reference specifically to FIG. 4, the following annotations apply:

TA' is an angle of movement of the trigger lever required to rotate the sear lever far enough to disengage the latch.

TD' is an distance from the trigger lever pivot 42 to the center of the first position 50'; second position 50"; and third position 50'".

TD" is a distance from the center of the first position 50', second position 50", and third position 50'" to an end of the trigger lever 38.

PD' is a distance the trigger-to-sear lever travels from an at-rest position to a fired position, relative to the sear lever pivot 36.

PD" is a distance the trigger-to-sear lever travels, in the first position 50', the second position 50", or the third position 50'", from an at-rest position to a fired position, relative to the trigger lever pivot 42.

SA' is an angle of movement of the sear lever 34 from an at-rest position to a fired position, relative to the sear pivot pin 36.

SD' is the distance between the latch projection 32 of the sear lever 12 and an axis of the sear lever pivot pin 36.

SD" is the distance between an axis of the sear lever pivot pin 36 to an axis of the trigger-to-sear lever pivot pin 48.

SA' is the angle of rotation of the sear lever 34 to disengage the latch 16.

All other elements being equal, as TD' increases and ID" decreases, the force required to move the trigger lever 38 from a first position to a second position increases.

Figure 4A:
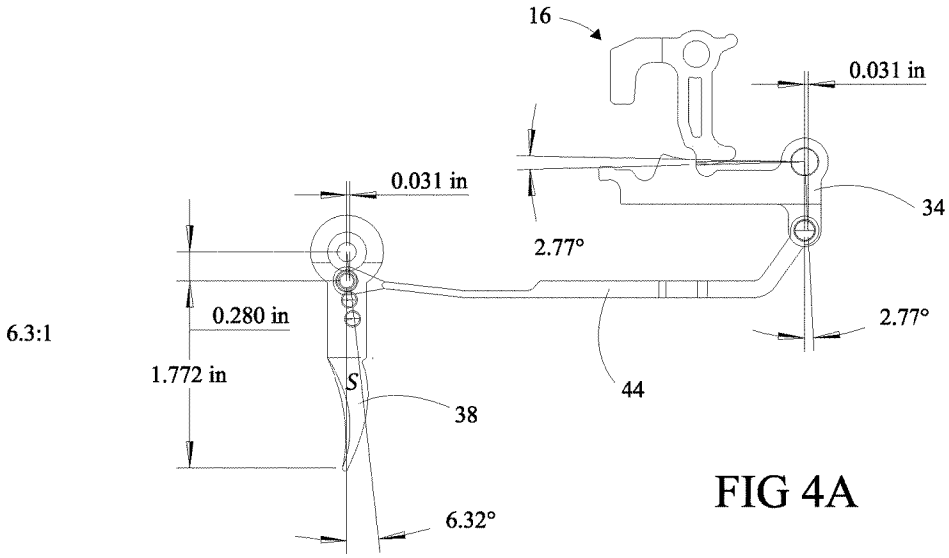
FIG. 4A is a side view of components of an adjustable crossbow trigger in a ready-to-fire position having a trigger-to-sear link in a first position, detailing pivot points and distance parameters, further showing example dimensions and angles in accordance with the present invention.
Figure 4B:
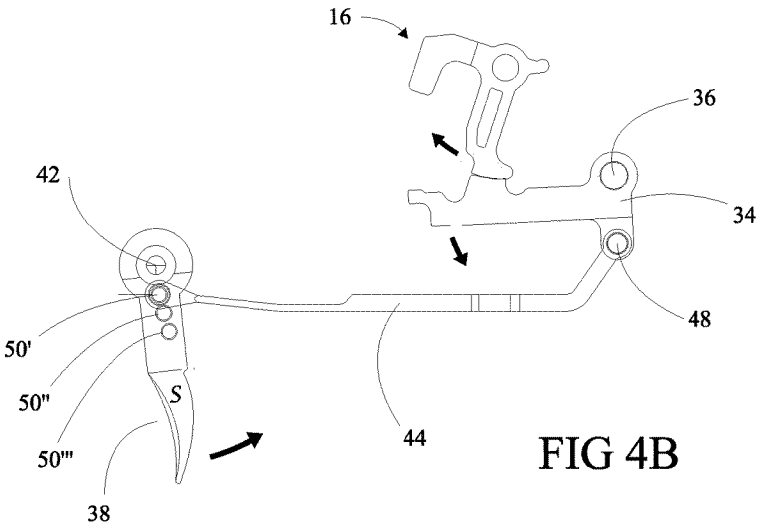
FIG. 4B is a side view of components of an adjustable crossbow trigger in a just-fired position having a trigger-to-sear link in a first position, detailing pivot points and distance parameters, showing example dimensions and angles in accordance with the present invention.
Figure 4C:
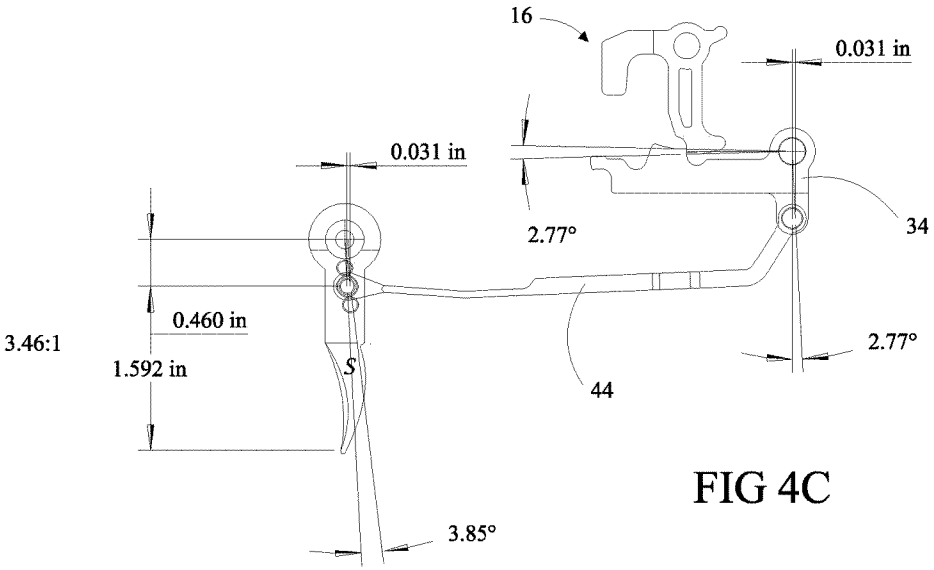
FIG. 4C is a side view of components of an adjustable crossbow trigger in ready-to-fire position having a trigger-to-sear link in a second position, detailing pivot points and distance parameters, showing example dimensions and angles in accordance with the present invention.
Figure 4D:
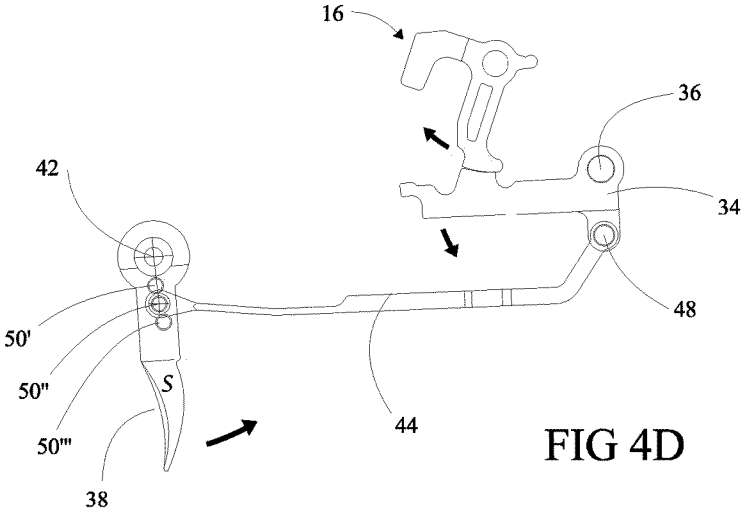
FIG. 4D is a side view of components of an adjustable crossbow trigger in a just-fired position having a trigger-to-sear link in a second position, detailing pivot points and distance parameters, showing example dimensions and angles in accordance with the present invention.

The distance PD' and angle SA' remain constant, no matter the position of 50', 50", or 50'". As illustrated in FIG. 4A, when the trigger-to-sear link 44 is in the first position, the trigger arm 38 must be rotated 6.32 degrees in order to rotate the sear lever 34 the required PD' in order to release the latch 16, as shown in FIG. 4B. As illustrated, the 6.32 degrees creates a leverage ratio of 6.3:1, which creates the lightest trigger pressure, and the longest trigger travel distance. As illustrated in FIG. 4C, when the trigger-to-sear link 44 is in the second position, the trigger arm 38 must be rotated 3.85 degrees in order to rotate the sear lever 34 the required PD' in order to release the latch 16 as shown in FIG. 4D. As illustrated, this 3.85 degrees creates a leverage ratio of 3.46:1, which creates an increase in trigger pressure, and the shortens the trigger travel distance.

Figure 4E:
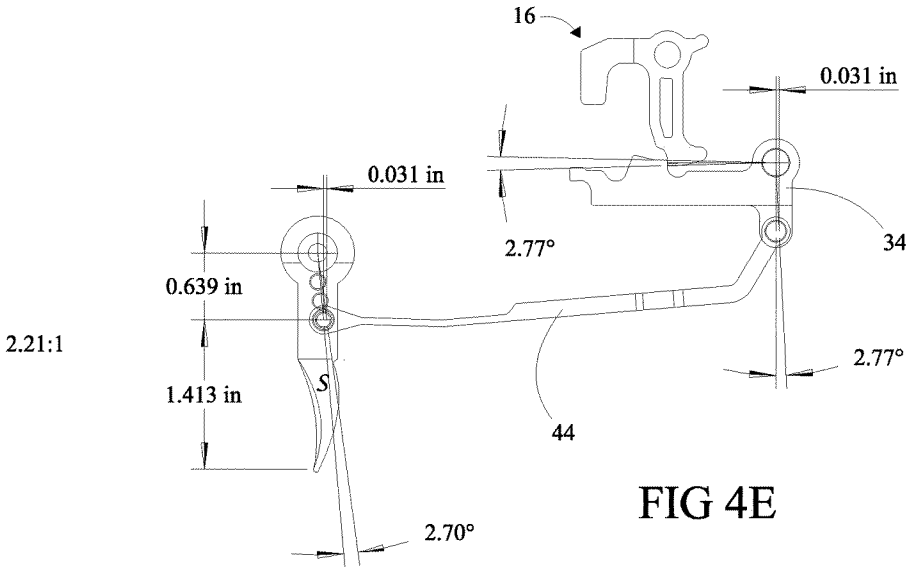
FIG. 4E is a side view of components of an adjustable crossbow trigger in a ready-to-fire position having a trigger-to-sear link in a third position, detailing pivot points and distance parameters, showing example dimensions and angles in accordance with the present invention.
Figure 4F:
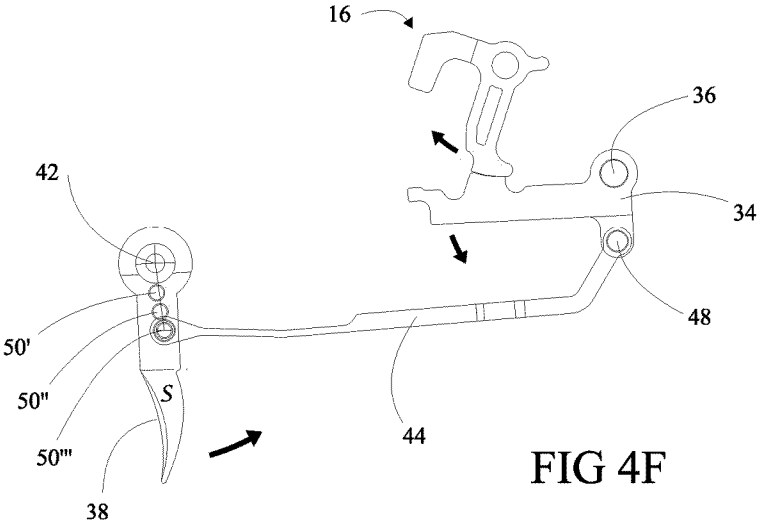
FIG. 4F is a side view of components of an adjustable crossbow trigger in a just-fired position having a trigger-to-sear link in a third position, detailing pivot points and distance parameters, showing example dimensions and angles in accordance with the present invention.

As illustrated in FIG. 4E, when the trigger-to-sear link 44 is in the third position, the trigger arm 38 must be rotated 2.70 degrees in order to rotate the sear lever 34 the required PD' in order to release the latch 16 as shown in FIG. 4F. As illustrated, the 2.70 degrees creates a leverage ratio of 2.21:1, which creates a further increase in trigger pressure, and the further shortens the trigger travel distance.

As an example, if the required direct force applied to the sear lever pivot point 48 were 10 pounds, the felt force trigger pull would be as follows:

Third Position 50'"; 10/2.21=4.52 pounds

Second Position 50"; 10/3.46=2.89 pounds

First Position 50'; 10/6.30=1.58 pounds

As an example, the required distance PD" the trigger lever 38 were to be pulled in order to move the sear lever pivot pin 48 would be as follows:

Third Position 50'''; (0.639"+1.413")=(2.052" Radius squared×3.14=12.886")/360 degrees=0.0357"×2.70 degrees=0.0963" Trigger lever travel.

Second Position 50"; (0.460"+1.592")=(2.052" Radius squared×3.14=12.886")/360 degrees=0.0357"×3.85 degrees=0.137" Trigger lever travel.

First Position 50"; (0.280"+1.772")=(2.052" Radius squared×3.14=12.886")/360 degrees=0.0357"×6.32 degrees=0.225" Trigger lever travel.

Referring back to FIG. 3A, the string latch 16 includes a latch base 52, an arrow shaft yoke 54, a sear notch 56, a spring projection 58 and a latch foot 60. The string latch 16 retains the string 110 in a safety latch position and releases the string 6 in a fire latch position. The arrow shaft yoke 54 extends from one side of the latch base 52 and the spring projection 58 extends from an opposing side of the latch base 52 at one end thereof. The sear notch 56 is formed on the one side of the latch base 52 and the latch foot 60 is formed on the opposing side of the latch base 52 at an opposing end thereof. The one end of the latch base 52 is pivotally retained in the mechanism cavity 26 with a pivot pin 62, adjacent the spring projection 58. A latch spring 64 is retained in a latch spring cavity 67. The latch spring 64 contacts the spring projection 58 and biases the latch foot 60 to contact the latch projection 32.

The latch finger 66 extends from one end of the combination anti-dryfire and sear lock lever with self centering 14 and the self centering surface 68 extends from an opposing end of the sear lock lever 14. The latch finger 66 is sized to capture the anti-dryfiring projection 30. Insertion of an arrow into the crossbow 100 and over the self centering surface 68 of the combination anti-dryfire and sear lock lever with self centering 14 causes the arrow to self-center, and the latch finger 66 of the combination anti-dryfire and sear lock lever with self centering 14 to pivot and release the anti-dryfiring projection 30 of the sear lever 12. A lock spring 70 is retained in a lock spring cavity 71. The lock spring 70 biases the latch finger 66 toward the anti-dryfiring projection 30.

A sear lever stop 72 extends outward from the mechanism cavity 26 in the trigger housing 10, above the sear base 28 and between the anti-dry firing projection 30 and the latch projection 32 to stop excessive upward motion of the sear lever 12.

The safety slide bar 20 includes a slide pin 78 and a position lock spring 80. A safety detent notch 82 is formed in a top of the safety slide bar 20. A detent ball 84 engages the safe detent notch 82, and is biased toward the safety bar 20 with the position lock spring 80. The position lock spring 80 is retained in a position lock cavity 81. The slide pin 78 is pressed through the safety slide bar 20 to be shuttled between a safe position and a fire position. The safety slide bar 20 is maintained in the safe position by the position lock spring 80 forcing the detent ball 84 into the safe detent notch 82. The safety slide bar 20 is maintained in the fire position, through friction, by the position lock spring 80 forcing the detent ball 84 on to the upper surface of the safety slide bar 20. When the safety slide bar 20 is moved from the fire position to the safety position, the position lock spring 80 decompresses, and forces the detent ball 84 into the safe detent notch 82, generally creating an audible noise. When the safety bar 20 is moved from the safe position to the fire position, the detent ball 84 is forced upwards, and compresses the lock spring 80 within the position lock cavity 81. This added pressure derived from further compressing the lock spring 80 provides adequate friction between the detent ball 84 and the upper surface of the safety bar 20 to hold the safety slide bar 20 in the fire position, without making an audible sound.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. An adjustable trigger for a crossbow comprising:

a linkage arm having a first end and a second end;

a string latch is capable of holding a string;

a sear lever is in contact with said string latch for preventing a release of the string from said string latch, said sear lever is not in contact with said string latch to allow a release of the string from said string latch;

a trigger lever includes a pivot point and at least two moment arm holes, said trigger lever is pivotally engaged with said crossbow at said pivot point, said first end of said linkage arm is pivotally engaged with one of said at least two moment arm holes, said second end of said linkage arm is pivotally engaged with said sear lever, a center point of said at least two moment arm holes are located on an end of an arc, said arc has an origin of a pivot point of said linkage arm and said sear lever, wherein a distance between said pivot point and a first moment arm hole is a distance TD', a distance between said pivot point and a second moment arm hole is a distance TD".

2. The adjustable trigger for a crossbow of claim 1 wherein:

a ratio of said TD" and said TD' is at least 4.0:1 when said linkage arm is pivotally engaged with said trigger lever.

3. The adjustable trigger for a crossbow of claim 1 wherein:

a ration between said TD" and said TD' is at least 4.5:1 when said linkage arm is pivotally engaged with said trigger lever.

4. The adjustable trigger for a crossbow of claim 1 wherein:

a ration between said TD" and said TD' is at least 5.0:1 when said linkage arm is pivotally engaged with said trigger lever.

5. The adjustable trigger for a crossbow of claim 1 wherein:

a ration between said TD" and said TD' is at least 5.5:1 when said linkage arm is pivotally engaged with said trigger lever.

6. The adjustable trigger for a crossbow of claim 1 wherein:

a ration between said TD" and said TD' is at least 6.0:1 when said linkage arm is pivotally engaged with said trigger lever.

7. An adjustable trigger for a crossbow comprising:

a linkage arm having a first end and a second end;

a string latch is capable of holding a string;

a sear lever is in contact with said string latch for preventing a release of the string from said string latch, said sear lever is not in contact with said string latch to allow a release of the string from said string latch;

a trigger lever includes a pivot point and at least two moment arm holes, said trigger lever is pivotally engaged with said crossbow at said pivot point, said first end of said linkage arm is pivotally engaged with one of said at least two moment arm holes, said second end of said linkage arm is pivotally engaged with said sear lever, a center point of said at least two moment arm holes are located on an end of an arc, said arc has an origin of a pivot point of said linkage arm and said sear lever, wherein a distance between said pivot point and a first moment arm hole is a distance TD', a distance between said pivot point and a second moment arm hole is a distance TD"; and a ratio between TD" and TD' is at least 4:1.

8. The adjustable trigger for a crossbow of claim 7 wherein:

the ration between TD" and TD' is at least 4.5:1.

9. The adjustable trigger for a crossbow of claim 7 wherein:

the ration between TD" and TD' is at least 5.0:1.

10. The adjustable trigger for a crossbow of claim 7 wherein:

the ration between TD" and TD' is at least 5.5:1.

11. The adjustable trigger for a crossbow of claim 7 wherein:

the ration between TD" and TD' is at least 6.0:1.

12. An adjustable trigger for a crossbow comprising:

a linkage arm having a first end and a second end;

a string latch is capable of holding a string;

a sear lever includes a sear pivot point and at least two moment arm holes, said sear lever is in contact with said string latch for preventing a release of the string from said string latch, said sear lever is not in contact with said string latch to allow a release of the string from said string latch; and a trigger lever includes a pivot point and a linkage hole, said trigger lever is pivotally engaged with said crossbow at said pivot point, said first end of said linkage arm is pivotally engaged with said linkage hole, said second end of said linkage arm is pivotally engaged with one of said at least two moment arm holes, a center point of said at least two moment arm holes are located on an end of an arc, said arc has an origin of a pivot point of said linkage arm and said trigger lever.

* * * * *